United States Patent [19]

Ito et al.

[11] Patent Number: 4,742,275

[45] Date of Patent: May 3, 1988

[54] HIGH PRESSURE METAL VAPOR DISCHARGE LAMP WITH STARTING ELEMENT

[75] Inventors: Akira Ito; Kouzou Kawashima, both of Yokohama, Japan

[73] Assignee: Kabushiki Kaisha Toshiba, Kawasaki, Japan

[21] Appl. No.: 45,232

[22] Filed: May 1, 1987

Related U.S. Application Data

[63] Continuation of Ser. No. 786,597, Oct. 11, 1985, abandoned.

[30] Foreign Application Priority Data

Oct. 12, 1984 [JP] Japan ..... 59-212560
Dec. 27, 1984 [JP] Japan ..... 59-273660

[51] Int. Cl.[4] ..... H05B 39/04

[52] U.S. Cl. ..... 315/104; 315/47; 315/59; 315/74; 315/75

[58] Field of Search ..... 315/104, 73, 74, 75, 315/59, 47

[56] References Cited

U.S. PATENT DOCUMENTS 2,286,789 6/1942 Dench ..... 315/59
2,332,077 10/1943 Hays ..... 315/59
4,135,114 1/1979 Narikiyo ..... 315/47
4,137,483 1/1979 Ochi et al. ..... 315/47
4,340,841 7/1982 Schupp ..... 315/75
4,388,557 6/1983 Shaffer ..... 315/74
4,481,446 11/1984 Tsuchihashi et al. ..... 315/47

OTHER PUBLICATIONS

German Patent Office Search report.

*Primary Examiner*—Harold Dixon
*Attorney, Agent, or Firm*—Cushman, Darby & Cushman

[57] ABSTRACT

A high pressure metal vapor discharge lamp comprises a light-emitting tube in which a pair of electrodes is enclosed, a starting element including a normally closed-type thermal switch and a resistive member, the starting element generating a pulse by closing and opening switch operations, a connecting element for electrically connecting the starting element to the electrodes, the pulse being applied to the electrodes through the connecting element, and a member including an insulating body provided in vicinity of the thermal switch for causing a conductive portion to be formed on the body, the conductive portion being sufficient to bypass a current supplied to the starting element by repetitions of the switch operations, thereby lowering the pulse voltage.

6 Claims, 8 Drawing Sheets

HIGH PRESSURE METAL VAPOR DISCHARGE LAMP WITH STARTING ELEMENT

This is a continuation of application Ser. No. 786,597, filed Oct. 11, 1985, which was abandoned upon the filing hereof.

BACKGROUND OF THE INVENTION

The present invention relates to a high pressure metal vapor discharge lamp having a thermal switch type starting element.

A high pressure metal vapor discharge lamp such as a high pressure sodium lamp has a light-emitting tube of a monocrystalline metal oxide such as ruby or sapphire, or polycrystalline alumina ceramic. Mercury, sodium and a starting rare gas such as xenon are used to fill in the light-emitting tube. The light-emitting tube is then inserted into an envelope having a base fixed to one of its ends. The high pressure sodium lamp has a considerably high efficacy compared to that of a high pressure mercury lamp, and is recently attracting much attention as a low-power light source.

Since a high pressure sodium lamp has a high starting voltage, it cannot, in fact, be started with a commercial AC power source voltage. Therefore, an expensive special ballast having a starting element is required for lighting the high pressure sodium lamp. Meanwhile, a high pressure sodium lamp with a starting element consisting of a resistive heater and a normally closed thermal switch incorporated within its envelope has been developed in order to facilitate starting. The thermal switch is heated by the resistive heater and operated, and the inside of the envelope is evacuated. A proximity conductor is arranged on the outer surface of the light-emitting tube of the high pressure sodium lamp of this type in order to further facilitate starting. A high voltage pulse generated by the starting element is applied across the proximity conductor and one of the electrodes. Since high pressure sodium lamps having the above arrangement can be started by considerably less expensive ballasts than for high pressure mercury lamps, such lamps have become widely accepted.

When a current flows in the resistive heater of the starting element incorporated in the envelope, the bimetal of the thermal switch is heated by the heat generated by the resistive heater, and opened. A high voltage pulse generated by this opening is superposed on the secondary voltage of the ballast and applied across a pair of electrodes of the light-emitting tube. At the same time, the pulse is applied across the proximity conductor and one of the electrodes to start discharge in the light-emitting tube. Once the thermal switch is opened, current supply to the resistive heater connected in series with the thermal switch is stopped. As a result, the switch is cooled and returns to its original closed state. When the switch returns to its original state, current supplied to the light-emitting tube connected in parallel with the starting element is decreased, causing extinction of the light-emitting tube or unstable discharge. In order to prevent this, the thermal switch must not return to the closed state once the lamp is turned on. For this purpose, the switch is positioned in the vicinity of the light-emitting tube so that it receives radiation heat from the light-emitting tube and maintains an open state.

However, when the electron emissive material coated on the electrodes is depleted and the discharge starting voltage is greatly increased near the end of the lifetime of the lamp, the lamp cannot be turned on even if the thermal switch is opened. As a result, the thermal switch cannot receive radiant heat from the light-emitting tube and is cooled to return to the original closed state. Then, current flows again through the resistive heater to open the switch. The on-off operation of the thermal switch is repeated until the lamp is turned on. A high voltage pulse is thus repeatedly applied to the ballast and wiring. As a result, in some cases dielectric breakdown occurs.

Since a lamp of this type is often installed in a high place, it cannot be easily replaced even when its starting voltage is increased. As a result, such a lamp tends to be left with power supplied to its starting element, resulting in dielectric breakdown of the ballast or wiring.

SUMMARY OF THE INVENTION

It is an object of the present invention to provide a high pressure metal vapor discharge lamp with a starting element, wherein a dielectric breakdown in an operating circuit such as a ballast or wiring can be prevented even when the starting voltage of the light-emitting tube is increased and the lamp cannot be turned on.

In order to attain the above object, a high pressure metal vapor discharge lamp according to the present invention comprises:

a light-emitting tube in which a pair of electrodes is enclosed;

a starting element including a normally closed-type thermal switch and a resistive member, the starting element generating a pulse by closing and opening switch operations;

a connecting element for electrically connecting the starting element to the electrodes, the pulse being applied to the electrodes through the connecting elements; and means including an insulating body provided in the vicinity of the thermal switch for causing a conductive portion of the body, the conductive portion being sufficient to bypass a current supplied to the starting element by repetition of the switch operations, thereby lowering the pulse.

With the above arrangement, the metal of the contact member is deposited on the surface of a solid insulator in response to the on-off operation of the thermal switch, so that a pulse voltage generated by the on-off operation of the switch can be decreased in accordance with the number of times the on-off operation of the switch is performed. Therefore, even when the starting voltage of the light-emitting tube is increased and the lamp cannot be turned on near the end of its lifetime, dielectric breakdown in the ballast or wiring of the operating circuit of the lamp can be prevented. As a result, a safe, high pressure metal vapor discharge lamp having a starting element is provided.

BRIEF DESCRIPTION OF THE DRAWINGS

Other objects and advantages will be apparent from the following description taken in conjunction with the accompanying drawings, in which.

DETAILED DESCRIPTION OF THE PREFERRED EMBODIMENTS

Figure 1:
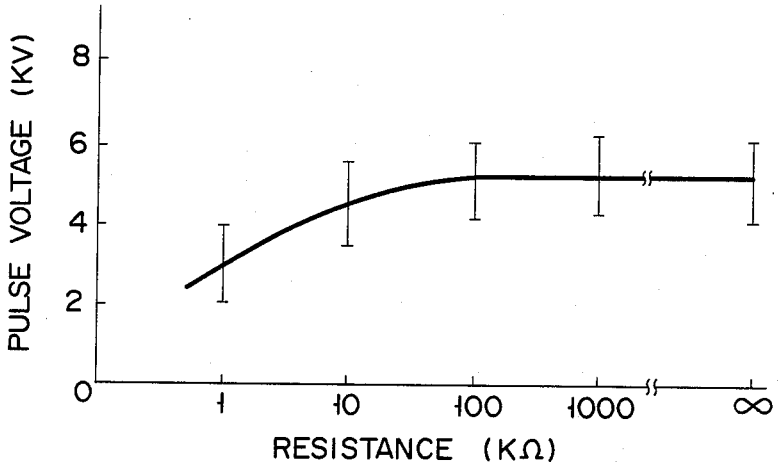
FIG. 1 shows a graph showing the relationship between the resistance of a resistor connected in parallel with a starting element and the pulse voltage generated by the starting element.

When a resistor is connected in series with a starting element, the value of the pulse voltage generated upon operation of the starting element varies. More particularly, the smaller the resistance, the lower the pulse voltage. When a resistor is not connected, a pulse voltage as high as 4 to 6 kV is generated, as shown in FIG. 1. In this case, when a resistor having a resistance of 10 kΩ is connected in parallel with the starting element, the pulse voltage is decreased to 3.5~5.5 kV. When a resistor having a resistance of 1 kΩ is connected, the pulse voltage is decreased to 2~4 kV.

When a pair of contacts of a thermal switch constituting the starting elements performs an on-off operation repeatedly, the metal material constituting the contacts is scattered in the form of fine particles. When the scattered fine particles are deposited on an insulating member to form a film, the thickness of the film of fine particles increases gradually. The contacts are usually made of a high melting point metal such as tungsten. A very thin high melting point metal film does not exhibit conductivity. However, when the film thickness exceeds several hundred Å, conductivity increases accordingly. Thus, when the film thickness exceeds 1,000 Å, it serves as a good conductor.

The inventors produced the present invention based on this fact. A first embodiment of the present invention will now be described with reference to FIG. 2.

Figure 2:
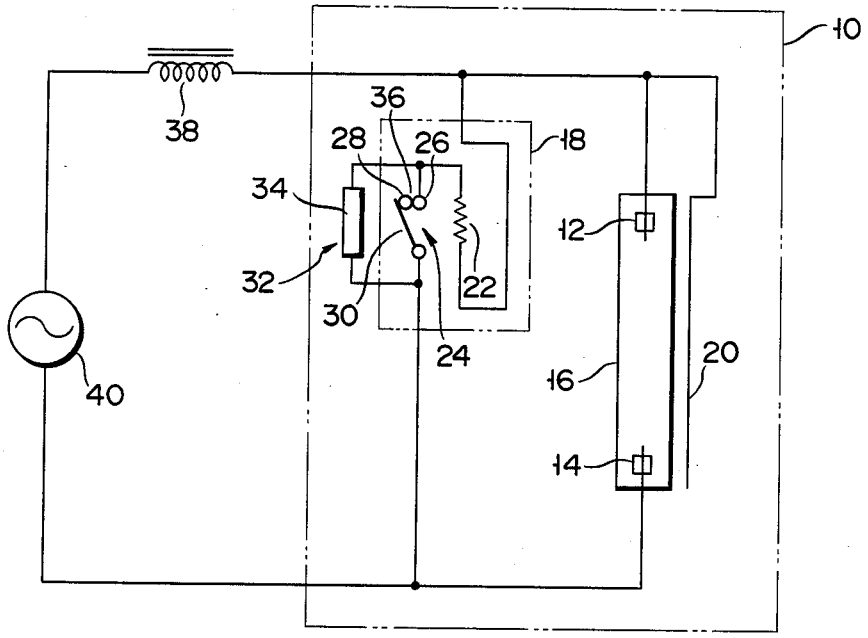
FIG. 2 is a circuit diagram of a high pressure metal vapor discharge lamp having a starting element according to a first embodiment of the present invention.

Referring to FIG. 2, a high pressure sodium lamp 10 has a light-emitting tube 16 with a pair of electrodes 12 and 14, one of which is situated at either end of the light-emitting tube 16, sodium as a light emitting material, a starting element 18 electrically connected in parallel to the electrodes 12 and 14, and a proximity conductor 20 provided in the vicinity of the outer wall of the tube 16. The element 18 consists of a resistive heater 22, having 20 Ω at a normal temperature, and a thermal switch 24 connected in series with each other. The switch 24 consists of a stationary tungsten contact 26 and a bimetal piece 30 on which a movable tungsten contact 28 is provided. The heater 22 opposes the piece 30 so that radiation heat therefrom is supplied to the piece 30 to thereby operate the switch 24. An insulating means 32 having tens of kΩ is arranged in parallel with the switch 24. The means 32 is provided in the vicinity of the switch 24 and has a solid insulator 34 at a portion thereof. The insulator 34 is arranged to be separated from a contact portion 36 of the contacts 26 and 28 by a maximum distance L of 12 mm.

The lamp 10 having the above-mentioned arranged is connected to a power source 40 through a ballast 38, and turned on.

When an electron emissive material coated on the electrodes 12 and 14 of the lamp 10 is exhausted and the tube 16 cannot be turned on near the end of the lifetime of the lamp 10, the switch 24 performs a repetitive on-off operation. However, since the maximum distance L between the contact portion 36 of the contacts 26 and 28 and the solid insulator 34 is set at 12 mm, tungsten, as the material of the contacts 26 and 28, is scattered and efficiently deposited on the surface of the insulator 34 in response to the on-off operation of the switch 24. The insulating property of the insulator 34 decreases to provide an equivalent circuit in which a resistor of about 1 kΩ is connected in parallel with the element 18. Therefore, the pulse voltage generated by the operation of the element 18 is decreased. Even when a pulse is repeatedly applied to the operating circuit of the lamp, dielectric breakdown does not occur in the operating circuit of the lamp.

The mechanism of dielectric breakdown prevention is explained as follows.

The lifetime of a lamp 10 of this type is normally 12,000 hours. Assuming that the lamp 10 is kept on for about 5.5 hours per start operation, the element 18 must be able to start the lamp 10 about 2,400 times throughout its lifetime. Approximately 10 on-off operations may be required for one starting, depending on the states of the power source and the circuit. Therefore, the element 18 must be able to withstand $10\times2{,}400=24{,}000$, i.e., about 30,000 on-off operations.

If the tube 16 cannot be turned on near the end of its lifetime, the element 18 starts switching the contacts at intervals of about 15 seconds. When the lamp is left alone for four weeks at a maximum, and power is supplied for about eight hours a day, the contacts of the element 18 operate {3,600 sec (1 hr.)×8 hr.×28 days (4 weeks)}/15 sec ≈54,000 times. Thus, if the lamp 10 cannot be turned on and the element 18 is operated near the end of its lifetime, the operation times of the contacts of the element 18 will be the sum of 30,000 times (during lifetime) and 54,000 times (while the lamp is left alone): 84,000 times or, at maximum, about 100,000 times. Based on the above, it is required to prevent dielectric breakdown of the ballast and wiring upon on-off operations of the element 18 totalling up to a maximum of 100,000 times.

Figure 3:
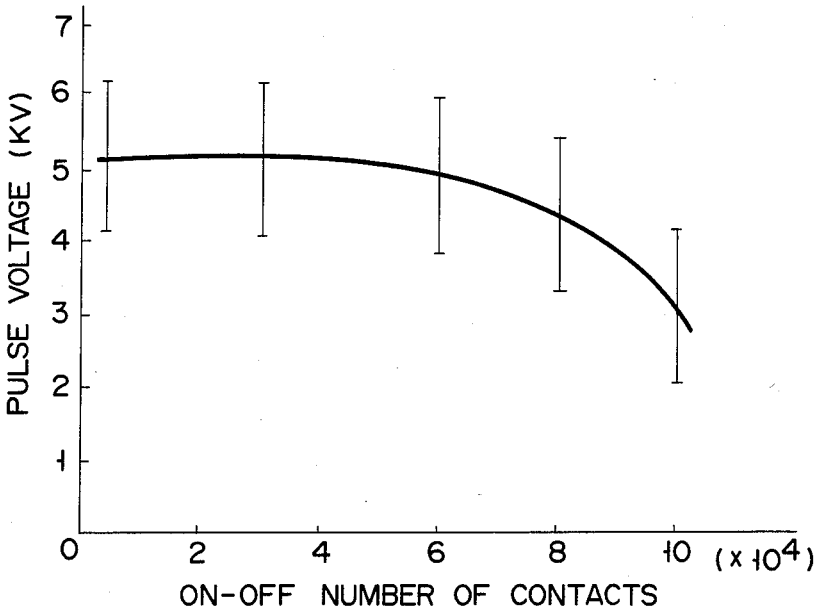
FIG. 3 shows a graph showing the relationship between the number of on-off contact times of the starting element and the pulse voltage.

FIG. 3 shows a graph representing the relationship between the number of on-off contact times (number of times of on-off operation) of the contacts 26 and 28 of the switch 24 of the lamp 10, and the pulse voltage generated upon each on-off operation. The curve is obtained by plotting average values of the pulse voltages at respective on-off times. Referring to FIG. 3, the pulse voltage decreases when the on-off times exceed 30,000. When the on-off times reach about 100,000, the pulse voltage decreases to about 60% of the initial voltage. In short, a pulse satisfactory for turning on the lamp 10 is generated by the element 18 until the lamp nears the end of its lifetime. When the lamp 10 cannot be turned on at the end of its lifetime, the pulse voltage generated by the element 18 is decreased and dielectric breakdown in the operating circuit of the lamp is prevented.

In the first embodiment, the maximum distance L between the portion 36 of the contacts 26 and 28 and the solid insulator 34 is designed to be 12 mm. However, the distance L may be designed based on the characteristics of an operating system, but it is preferable that the distance L be designed to be under 15 mm. When the maximum distance L exceeds 15 mm, forming of the film on the insulator 34 is slow. Since the resistance of the insulator 34 does not rapidly decrease, the pulse voltage generated by the element 18 likewise does not decrease. As a result, it is difficult to completely prevent dielectric breakdown in a circuit such as a ballast or wiring.

In order to confirm the above-mentioned effects, 5 groups of 40 starting elements (200 in total) having, as shown in FIG. 2, maximum distances L of 4, 7, 10, 15 and 18 mm, were manufactured. Among these, 20 pieces of each maximum distance group were incorporated in high pressure sodium lamps which could be turned on by a single choke type ballast having a rated power consumption of 360 W. The lamps were then subjected to a long-term continuous life test of ON for 5.5 hours and OFF for 0.5 hours. The remaining 20 pieces of each maximum distance group were incorporated in envelopes having no light-emitting tube, connected to 400 W mercury lamp ballasts, and subjected to a continuous on-off test of 100,000 times.

The results of the above two tests are shown in Table 1. Referring to Table 1, at the end of a life test of over 12,000 hours, insulation failure occurred in solid insulators of eight pieces of NH360.L (low voltage start type lamp), incorporating a starting element having a maximum distance L of 4 mm, and pulse voltage, accordingly, decreased excessively. Essentially, the starting failure rate after the rated lamp lifetime should be no higher than 50%. Thus, the NH360.L incorporating the starting element having a maximum distance L of 4 mm shows too high a starting failure rate is not preferable. In contrast to this, the NH360.L incorporating a starting element having a maximum distance L of more than 7 mm shows no starting failure because of a decrease in the pulse voltage after the elapse of 12,000 hours.

TABLE 1

| L(mm) | Starting Failure Rate due to Pulse Voltage Decrease after 12,000 hr Operation | Insulation Failure Rate of Ballast Winding after ON-OFF TEST of 100,000 Times |
|---|---|---|
| 4 | 8/20 | 0/20 |
| 7 | 0/20 | 0/20 |
| 10 | 0/20 | 0/20 |
| 15 | 0/20 | 0/20 |
| 18 | 0/20 | 3/20 |

Usually, when a starting failure occurs in a light-emitting tube, its starting element is assumed to have repeated the on-off operation 100,000 times before the lamp is replaced by a new one. Referring to Table 1, when the starting element having a maximum distance L of 18 mm is operated 100,000 times, insulation failure occurs at a rate of 3/20 across the ballast winding. On the other hand, insulation failure does not occur in any lamp having a starting element with a maximum distance L of less than 15 mm.

In this manner, when the maximum distance L of a high pressure sodium lamp having a lifetime of 12,000 hours is set at 7 mm$<$L$<$15 mm, starting failure does not occur in the lamp before the elapse of 12,000 hours. Even if starting failure occurs in the light-emitting tube, insulation failure does not occur in the ballast.

A lamp having a lifetime of 12,000 thus must have a maximum distance L of 7 mm. For example, lamps having lifetimes of 9,000 and 24,000 hours may be set to have maximum distances L of more than 6 and 10 mm, respectively. Then, when the high-pressure sodium lamp is turned on for the rated lifetime, it will be protected from starting failure resulting from the excessive decrease in pulse voltage.

If the maximum distance L is set at less than 15 mm, no insulation failure occurs in the ballast until the starting element accomplishes 100,000 on-off operations. If the ballast can be protected from insulation failure before accomplishing the on-off operation 100,000 times, the effect of the present invention can also be obtained in a lamp having a lifetime of 9,000 or 24,000 hours. However, since insulation characteristics of the ballast can be improved, the maximum distance L can be set at more than 15 mm according to an increase in the insulation characteristics of the ballast.

Figure 4:
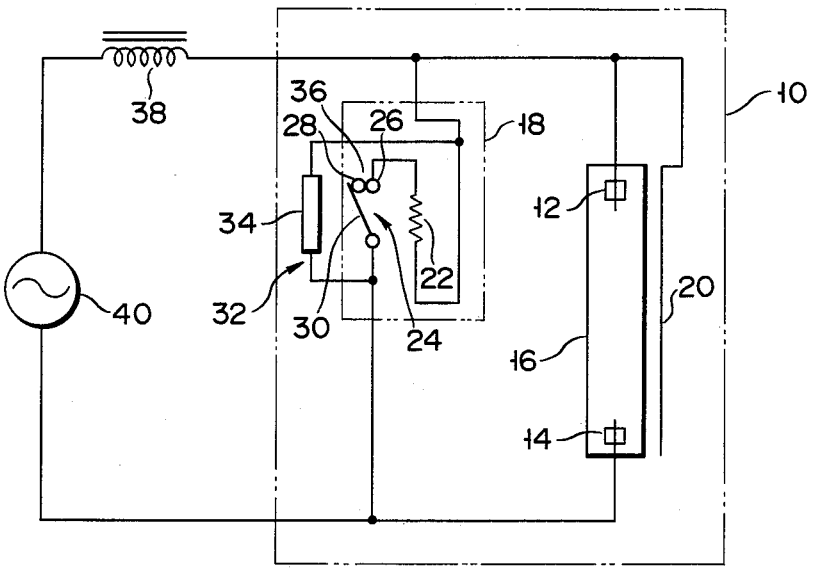
FIGS. 4 and 5 are circuit diagrams of a high pressure metal vapor discharge lamp having a starting element according to second and third embodiments of the present invention.

A high pressure metal vapor discharge lamp having a starting element according to a second embodiment of the present invention will now be described with reference to FIG. 4. In the second embodiment, an insulating means 32 is provided in parallel with a thermal switch 24. More particularly, one end of a solid insulator 34 is connected to a node between a bimetal piece 30 and an electrode 14. The other end of the insulator 34 is connected to a node between a resistive heater 22 and an electrode 12. Note that the insulator 34 is arranged to be spaced apart from a contact portion 36 of contacts 26 and 28 by a maximum distance L of less than 15 mm. With this exception the second embodiment has the same arrangement as that of the first embodiment. The same reference numerals in FIG. 4 denote the same portions as in FIG. 2 and a detailed description thereof is omitted. With this arrangement, a pulse sufficient for turning on a lamp 10 is generated by a starting element 18 during the lifetime of the lamp 10. When the lamp 10 cannot be turned on at the end of its lifetime, the pulse voltage generated by the element 18 is decreased in order to prevent dielectric breakdown in the operating circuit of the lamp.

Figure 5:
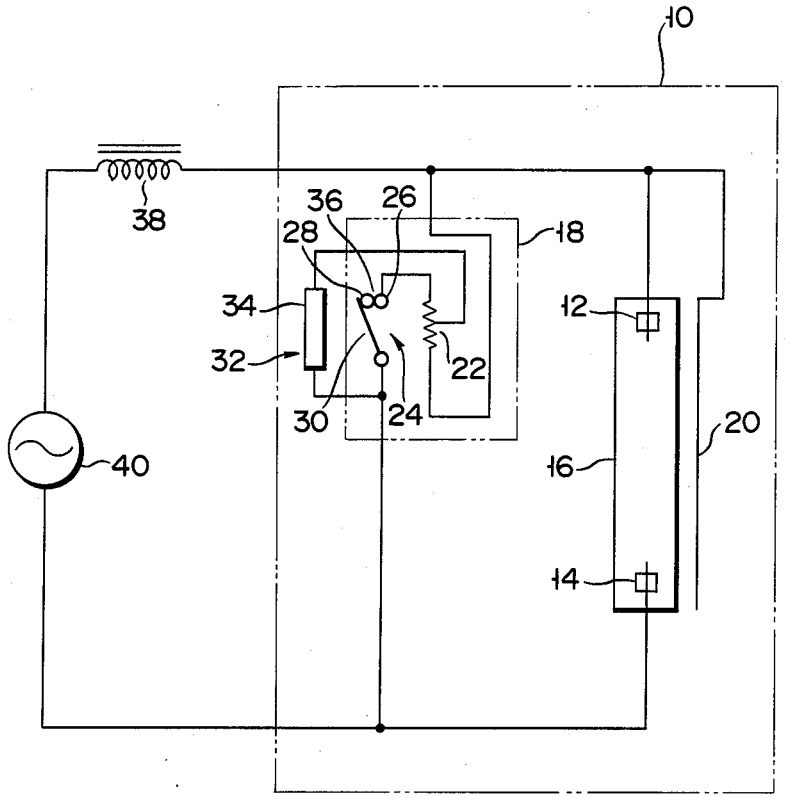

A high pressure metal vapor discharge lamp having a starting element according to a third embodiment of the present invention will be described with reference to FIG. 5. In the third embodiment, an end of an insulating means 32 is connected to a node between a bimetal piece 30 and an electrode 14, and the other end thereof is connected to a given portion of a resistive heater 22. In the third embodiment, a solid insulator 34 is arranged to be spaced apart from a contact portion 36 of contacts 26 and 28 by a maximum distance L of less than 15 mm. With this exception, the third embodiment has the same arrangement as that of FIG. 2. The same reference numerals in FIG. 5 denote the same portions as in FIG. 2, and a detailed description thereof is omitted. With this arrangement, the same effect as in the first and second embodiments can be obtained.

Figure 6:
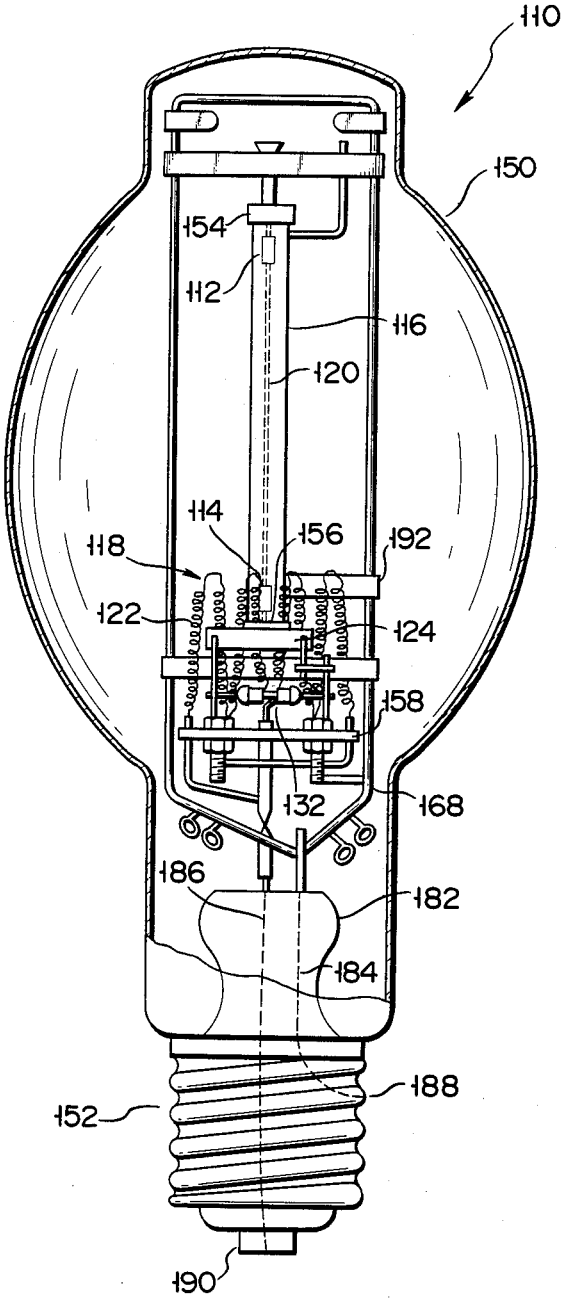
FIG. 6 is a front view of a high pressure metal vapor discharge lamp having a starting element according to a fourth embodiment of the present invention.

A more practical fourth embodiment of the present invention will now be described with reference to FIGS. 6 and 7. FIG. 6 shows a high pressure sodium lamp, with a starting element, of a rated power consumption of 360 W. A base 152 is mounted on an end of an envelope which is kept at high vacuum. A light-emitting tube 116 is sealed inside the envelope 150. The tube 116 is made of, e.g., translucent alumina ceramic. Both ends of the tube 116 are hermetically sealed by sealing members 154 and 156 supporting electrodes 112 and 114, respectively. Sodium, as a light emitting material, xenon gas as a starting rare gas, and mercury as a buffer material are filled in the tube 116. A starting element 118 is electrically connected in parallel with the tube 116. The element 118 consists of a thermal switch 124 assembled on an insulating substrate 158, and a coil filament resistive heater 122 connected in series with the switch 124.

Figure 7:
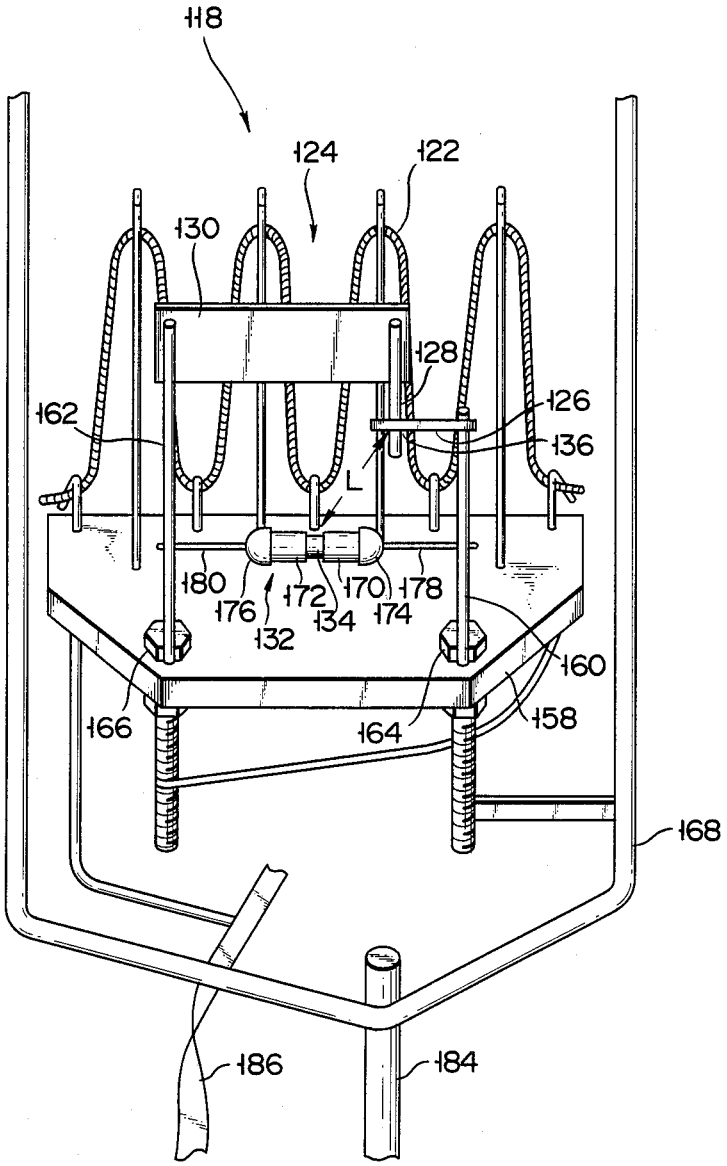
FIG. 7 is a front view of the starting element of the high pressure metal vapor discharge lamp according to the fourth embodiment of the present invention.

As shown in FIG. 7, the switch 124 has a pair of tungsten contacts 126 and 128. The stationary contact 126 is fixed to the insulating substrate 158 by a bolt 164 through a support member 160. The movable contact 128 is attached to the insulating substrate 158 by a bolt 166 through a bimetal piece 130 and its support member 162. The bolt 164 is connected to a light-emitting tube support member 168 to be described later, and the bolt 166 is connected to one end of the heater 122.

Furthermore, an insulating means 132 is provided between the members 160 and 162. Thus, the means 132 is electrically connected in parallel with the switch 124. A solid insulator 134 constituting the means 132 is spaced apart from a contact portion 136 of the contacts 126 and 128 by a distance L=10 mm. The means 132 consists of the solid insulator 134 comprising, e.g., a mullite round rod, a pair of conductors 170 and 172 comprising, e.g., conductive carbon films formed at the two ends of the solid insulator 134 at distances of 1 mm therefrom, and a pair of lead wires 178 and 180 connected to metal caps 174 and 176, respectively. The wires 178 and 180 are connected to the members 160 and 162, respectively.

Inner wires 184 and 186 are sealed in a stem 182 sealed to one end of the envelope 150. One end of the wire 184 is connected to a threaded portion 188 of the base 152, and the other end thereof is connected to the member 168 of the tube 116. The member 168 also serves as the power supply member for the electrode 112. One end of the wire 186 is connected to a top 190 of the base 152, and the other end thereof is connected to the electrode 114.

A proximity conductor 120 is arranged along the longitudinal direction on the outer surface of the tube 116. One end of the conductor 120 is connected to the member 168 through a heat responsive metal member 192.

The lamp 110 having the above arrangement is connected to an AC power source (not shown) through a single-choke type mercury lamp ballast for a 200 V AC power source, and turned on. Before starting the lamp, the contacts 126 and 128 of the switch 124 are closed so that a current of about 0.77 A flows to the heater 122, thereby generating heat. The piece 130 is bent by the heat from the heater 122, and the contacts 126 and 128 are opened. A high kick voltage pulse of 4 to 6 kV is generated upon the opening operation of the contacts. The high kick voltage pulse causes arc discharge in the tube 116, so that the lamp 110 is turned on. Note that the switch 124 is open due to radiation heat from the tube 116 while the lamp is on, and is not turned on again.

The object of the present invention can be attained by the above arrangement. Note that the distance L between the contact portion 136 between the contacts 126 and 128 and the solid insulator 134 can be set at a predetermined value other than 10 mm in accordance with the rated lifetime of the lamp and the insulating characteristics of the operating circuit.

In the fourth embodiment, the gap between the pair of conductors 170 and 172 is set at 1 mm. This gap is preferably set within a range of 0.5 and 5 mm. If the gap is smaller than 0.5 mm, the pulse voltage generated by the element 118 decreases too rapidly. On the other hand, if the gap exceeds 5 mm, the distance varies between the portion 136 and a given point on the insulator 134. Therefore, the film thickness of the contact material formed on the insulator 134 becomes nonuniform. As a result, even when the tube 116 causes starting failure and the switch 124 repeats its on-off operation, neither the electric insulation performance of the solid insulator 134 decreases rapidly, nor can the pulse voltage be decreased rapidly, resulting in disadvantage.

Figure 8:
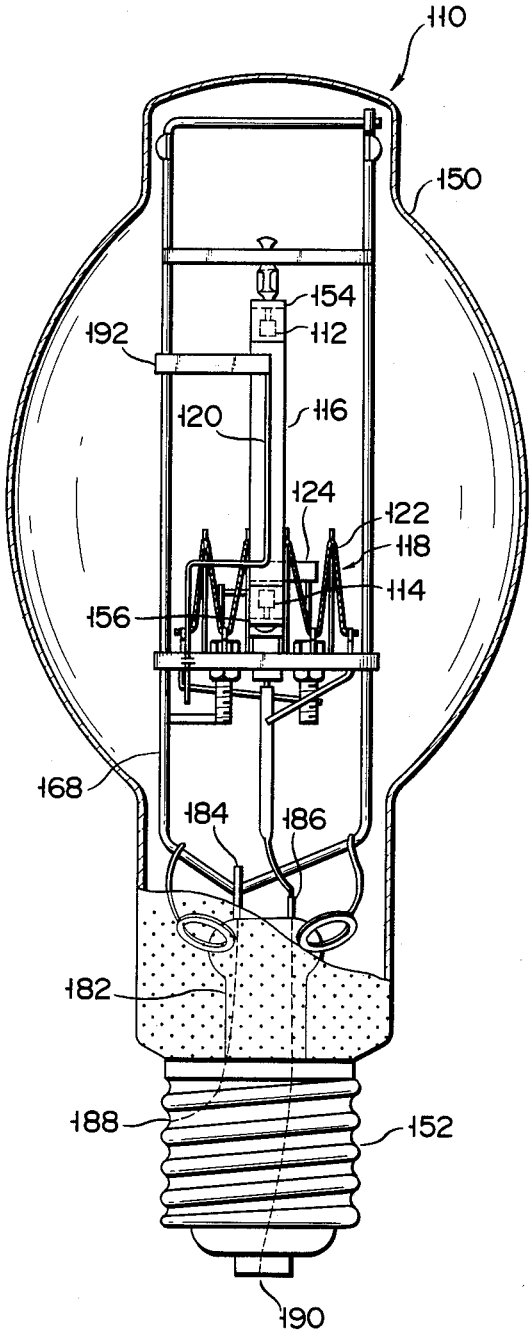
FIG. 8 is a front view of a high pressure metal vapor discharge lamp having a starting element according to a fifth embodiment of the present invention.

A more practical fifth embodiment of the present invention will now be described with reference to FIGS. 8 and 9. FIG. 8 shows a high pressure sodium lamp, with a starting element, of a rated power consumption of 360 W. A base 152 is mounted on an end of an envelope 150 which is kept at high vacuum. A light-emitting tube 116 is provided inside the envelope 150. The tube 116 is made of, e.g., translucent alumina ceramic. Both ends of the tube 116 are hermetically sealed by sealing members 154 and 156 supporting electrodes 112 and 114, respectively. Sodium, as a light emitting material, xenon gas as a starting rare gas, and mercury as a buffer material are used to fill in the tube 116. A starting element 118 is electrically parallel connected to the electrodes 112 and 114. The element 118 consists of a thermal switch 124 assembled on an insulating substrate 158, and a coil filament resistive heater 122 connected in series with the switch 124.

Figure 9:
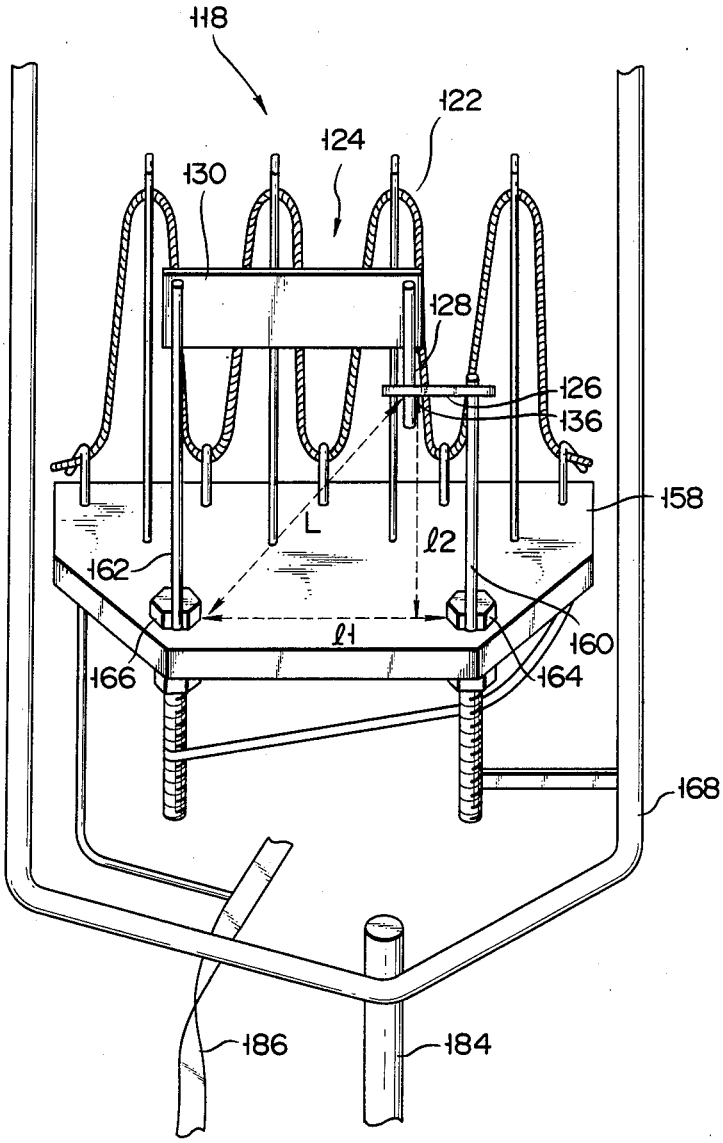
FIG. 9 is a front view of the starting element of the high pressure metal vapor discharge lamp according to the fifth embodiment of the present invention.

As shown in FIG. 9, the switch 124 has a pair of tungsten contacts 126 and 128. The stationary contact 126 is fixed to the insulating substrate 158 by a bolt 164 through a support member 160. The movable contact 128 is attached to the insulating substrate 158 by a bolt 166 through a bimetal piece 130 and its support member 162. The bolt 164 is connected to a light-emitting tube support member 168 to be described later, and the bolt 166 is connected to one end of the heater 122.

In the fifth embodiment, the maximum distance L between a straight line l1 defining a minimum distance between the members 160 and 162 along the surface of the insulating substrate 158 and a contact portion 136 of the contacts 126 and 128 is set at 12 mm. The height l2 of the portion 136 from the insulating substrate 158 is set at 5 mm.

Inner wires 184 and 186 are sealed in a stem 182 sealed to one end of the envelope 150. One end of the wire 184 is connected to a threaded portion 188 of the base 152 and the other end thereof is connected to the member 168 of the tube 116. The member 168 also serves as a power supply member for the electrode 112. One end of the wire 186 is connected to the top 190 of the base 152 and the other end thereof is connected to the electrode 114.

A proximity conductor 120 is arranged along the longitudinal direction on the outer surface of the tube 116. One end of the conductor 120 is connected to the member 168 through a heat responsive metal member 192.

The lamp 110 having the above arrangement is connected to a power source (not shown) through a single-choke type mercury lamp ballast for a 200 V AC power source, and turned on. Before starting the lamp, the contacts 126 and 128 of the switch 124 are closed so that a current of about 0.77 A flows to the heater 122, thereby generating heat. The piece 130 is bent by the heat from the heater 122, and the contacts 126 and 128 are opened. A high kick voltage pulse of 4 to 6 kV is generated upon the opening operation of the contacts. The high kick voltage pulse causes are discharge in the tube 116 so that the lamp 110 is turned on. Note that the switch 124 is open due to radiation heat from the tube 116 while the lamp is on, and is not turned on again.

The object of the present invention can be attained by the above arrangement. In the fifth embodiment, the height l2 of the portion 136 of the switch 124 from the substrate 158 is set at 5 mm. However, the height l2 is not limited to this but can be any proper value. However, if the height l2 is too small, tungsten scattered from the portion 136 lands substantially parallel to the substrate 158 and attaches thereto. Then, variation in resistance in a conduction state tends to be large. Therefore, l2 is preferably more than 3 mm in order to suppress the variation in resistance.

Figure 10:
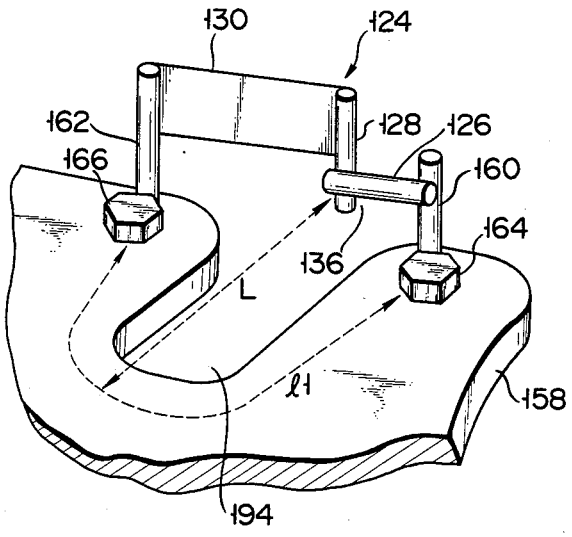
FIG. 10 is a front view of the starting element of a high pressure metal vapor discharge lamp according to a sixth embodiment of the present invention.

A more practical sixth embodiment of the present invention will be described with reference to FIG. 10. In the sixth embodiment of FIG. 10, only the main part of the present invention, i.e., a portion of a starting element 118 is shown. A notch 194 is formed in an insulating substrate 158 between a support member 160 for a stationary contact 126 and a support member 162 for a movable contact 128. In this case, a minimum distance l1 between the members 160 and 162 is given by the curve defined along the notch 194 in the substrate 158, as shown in FIG. 10. The distance L indicates the maximum distance between the portion 136 of the contacts 126 and 128 and the curve l1.

In the sixth embodiment, a similar effect to that mentioned above can be obtained.

The present invention is not limited to the particular embodiments described above. Various changes and modifications may be made regarding the configuration and the shape of the thermal switch. Also, the type of the lamp is not limited to a high pressure sodium lamp, but can be a high pressure metal vapor discharge lamp, with a starting element, such as a lamp sealing an alkali metal of another type, or a lamp sealing a metal halide.

What is claimed is:

1. A high pressure metal vapor discharge lamp connected to a power supply via a ballast, comprising:

an envelope in which a discharge tube with a pair of electrodes is disposed;

a starting element, connected in parallel with said electrodes of said discharge tube, comprising a thermal switch having a pair of contacts and a heater element connected in series with said contacts, said contacts being composed of contact material which is scattered upon opening and closing of said contacts in response to a starting current from said power source through said ballast; and an insulating body connected substantially in parallel with said starting element by a pair of leads attached to said insulating body with a spacing from each other, said insulating body being disposed in the vicinity of a contact point of said contacts of said thermal switch such that contact material which is scattered upon opening and closing of said contacts is deposited on said insulating body between said leads so as to form a conductive connection between said leads, wherein a resistance of said insulating body decreases in response to the amount of said contact material deposited on said insulating body due to repeated operations of said thermal switch, thereby decreasing an equivalent resistance of said insulating body and said starting element so as to decrease a starting voltage of said starting element in response to said starting current from said power source.

2. The discharge lamp according to claim 1, wherein a distance between said insulating body and said contact point of said thermal switch is less than about 15 mm.

3. The discharge lamp according to claim 1, wherein said contacts comprise a stationary contact element and a movable contact element, respectively.

4. The discharge lamp according to claim 3, wherein said insulating body includes an insulating substrate for supporting said thermal switch.

5. The discharge lamp according to claim 4, wherein said pair of leads comprises a first support member for supporting said stationary contact element above said insulating substrate and a second support member for supporting said movable contact element above said insulating substrate, said first and second support members being attached on said insulating substrate.

6. The discharge lamp according to claim 5, wherein a distance from said contact point of said stationary and movable contact elements to a shortest line connecting to said first and second support members along a surface of said insulating substrate is less than about 15 mm.

* * * * *